US007121188B2

(12) United States Patent
Thoms et al.

(10) Patent No.: US 7,121,188 B2
(45) **Date of Patent: *Oct. 17, 2006**

(54) AXIAL PISTON MACHINE HAVING A DEVICE FOR THE ELECTRICALLY PROPORTIONAL ADJUSTMENT OF ITS VOLUMETRIC DISPLACEMENT

(75) Inventors: Reinhardt Thoms, Neumunster (DE); Carsten Fiebing, Jevenstedt (DE); Bernd Hames, Henstedt-Ulsburg (DE); Martin Wüstefeld, Neumunster (DE)

(73) Assignee: Sauer-Danfoss Inc., Ames, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/106,219

(22) Filed: Apr. 14, 2005

(65) Prior Publication Data

US 2006/0005699 A1 Jan. 12, 2006

(30) Foreign Application Priority Data

Jul. 9, 2004 (DE) ..... 10 2004 033 314

(51) Int. Cl.
*F15B 13/00* (2006.01)

(52) U.S. Cl. ..... 91/506; 92/12.2

(58) Field of Classification Search ..... 91/506; 92/12.2; 74/839; 417/222.1
See application file for complete search history.

(56) References Cited

U.S. PATENT DOCUMENTS

| | | | | |
|---|---|---|---|---|
| 3,812,765 | A * | 5/1974 | Himmler | 91/506 |
| 4,478,136 | A * | 10/1984 | Heiser et al. | 91/506 |
| 4,599,050 | A * | 7/1986 | Ishizaki et al. | 417/222.1 |
| 4,600,364 | A * | 7/1986 | Nakatani et al. | 417/216 |
| 4,756,157 | A * | 7/1988 | Appel | 60/444 |
| 2006/0008358 | A1 * | 1/2006 | Thoms et al. | 417/222.1 |

* cited by examiner

*Primary Examiner*—Edward K. Look
*Assistant Examiner*—Michael Leslie

(57) ABSTRACT

An axial piston machine having a swash plate or oblique axis which can be adjusted by means of servopistons and has a valve segment and an adjustment unit for the electrically proportional adjustment of the volumetric displacement, the adjustment unit comprising proportional magnets which can be activated electrically, and a control piston for controlling the oil pressure which moves the servopistons, the proportional magnets acting on this control piston along a common tappet axis. A feedback device for feeding back the current swash plate or oblique axis valve segment position is provided. The feedback device comprises spring levers and a pointer which can be pivoted about an axis, the pointer which is embodied as a two-armed lever engaging in the control piston on one side of the pivot axis, and between the spring levers on the other side.

14 Claims, 18 Drawing Sheets a)

d)

a)

b)

a)

b)

a)

b)

AXIAL PISTON MACHINE HAVING A DEVICE FOR THE ELECTRICALLY PROPORTIONAL ADJUSTMENT OF ITS VOLUMETRIC DISPLACEMENT

BACKGROUND OF THE INVENTION

The invention relates to an axial piston machine having a device for the electrically proportional adjustment of its volumetric displacement according to the features of claim 1.

Axial piston machines such as hydraulic pumps and motors in an open or closed circuit and of swash plate design or oblique axis design are often actuated using an electrically proportional adjustment. The input signal into this adjustment unit is an electrical current. Its output signal is a hydraulic pressure. The outgoing oil pressure acts on servopistons of the axial piston machine which thus move along their movement axis. This movement is transmitted, for example, to a swash plate which, by changing its angular position, changes the volumetric displacement of the axial piston machine.

The current position of the swash plate or oblique axis is fed back to the electrically actuated adjustment unit via a mechanical feedback system. By means of this feeding back of the position, the control circuit is closed and it is ensured that the volumetric displacement of the axial piston machine also behaves proportional to the electric current at the adjustment unit. The system has a control piston which moves by means of at least one proportional magnet, but generally is displaced along its movement axis by two proportional magnets which are arranged opposite one another at its end faces, and as a result connects or disconnects ducts in such a way that oil is made available with a specific pressure for moving the servopistons. In known axial piston machines, a lever and spring system is provided for this purpose, which system ensures that the angle of the swash plate or of the valve segment in relation to the oblique axis is fed back to the control piston.

Known feedback mechanisms have structurally induced problems. On the one hand, any form of mechanical hysteresis between levers, springs and proportional magnets adversely affects the desired proportional adjustment characteristic owing to the sensitive equilibrium of forces, and on the other hand previous solutions require differently dimensioned adjustment devices depending on the overall size of the axial piston machine, which adjustment devices give rise to large overall widths in some cases owing to the lever mechanisms which are used. The proportional magnets are then a correspondingly large distance apart from one another. Since they are mounted on an exposed position on the axial piston machine, this increases the risk of damage and makes it unsuitable to use such adjustment units on axial piston machines with a small volumetric displacement and correspondingly small installation space.

The invention is based on the object of providing an axial piston machine with improved adjustment system.

SUMMARY OF THE INVENTION

This object is achieved with the axial piston machine according to claim 1. According to the invention, the axial piston machine has a swash plate which can be adjusted by means of servopistons, or in the case of an oblique axis machine a corresponding valve segment and an adjustment unit for electrically proportionally adjusting the volumetric displacement, the adjustment unit comprising proportional magnets which can be activated electrically, and a control piston for controlling the oil pressure which moves the servopistons, and the proportional magnets acting on this control piston along a common tappet axis. A feedback device for feeding back the current swash plate or oblique axis valve segment position is provided. The feedback device comprises spring levers and a pointer which is embodied as a two-armed lever, which can be pivoted about an axis, the pointer engaging in the control piston on one side of the pivot axis, and between the spring levers on the other side.

The spring levers on the pivot axis are preferably each mounted with a bearing shell, each of which is composed of two component shells which support the spring lever at separate locations on the axis and enclose the bearing of the pointer between them. With the exception of an angular range which remains free for the spreading of the spring levers, the bearing shell of each spring lever encloses a half-space about the pivot axis. This arrangement avoids a situation in which tilting moments which would lead to inaccuracies of the adjustment device and to increased frictional forces occur at the spring levers which are stressed one against the other.

A further advantageous refinement consists in the fact that the pointer is not mounted directly on the pivot axis but rather on the spring levers. The pointer always inevitably follows one of the spring levers. Frictional forces are significantly reduced by its mounting on the spring levers.

Embodiments in which the levers are each mounted in a fork-like fashion on the pivot axis are particularly advantageous, i.e. free of tilting moments, so that they are supported at two locations on the axis and thus enclose the bearing of the pointer 3 between them, or in which the pointer is mounted with a fork on the pivot axis, with the result that it is supported at two locations on the axis, the fork of the pointer enclosing the bearings of the spring levers.

For reasons of reducing friction, the pointer head and the faces of the spring levers on which it bears are processed separately, in particular coated in a friction-reducing fashion. The pointer head may be of cylindrical or spherical construction here, or have a rectangular cross section.

It is particularly advantageous if the end of the pointer which engages in the control piston is guided as a ball in a corresponding bore in the control piston, and the point of engagement of the pointer in the control piston lies outside the centre line of the piston. In this way, a largely hysteresis-free feedback is produced, which at the same time prevents the control piston from turning. In order to avoid one-sided loading of the control piston, and an associated tilting moment, the point of engagement of the pointer in the control piston lies on the tappet axis of the magnets, which axis is thus also offset towards the centre line of the control piston.

The control piston is preferably provided along its length with a bore through which oil, which escapes due to unavoidable leakages, is conducted away.

A great advantage of the present invention is that an entire series of axial piston machines with different volumetric displacements can be covered with the adjustment device, it being possible to use the same adjustment device for all models of the series by using the pointer.

Further refinements and advantages of the invention emerge from the subsequent description of the figures.

DETAILED DESCRIPTION OF THE PREFERRED EMBODIMENT

Figure 1:
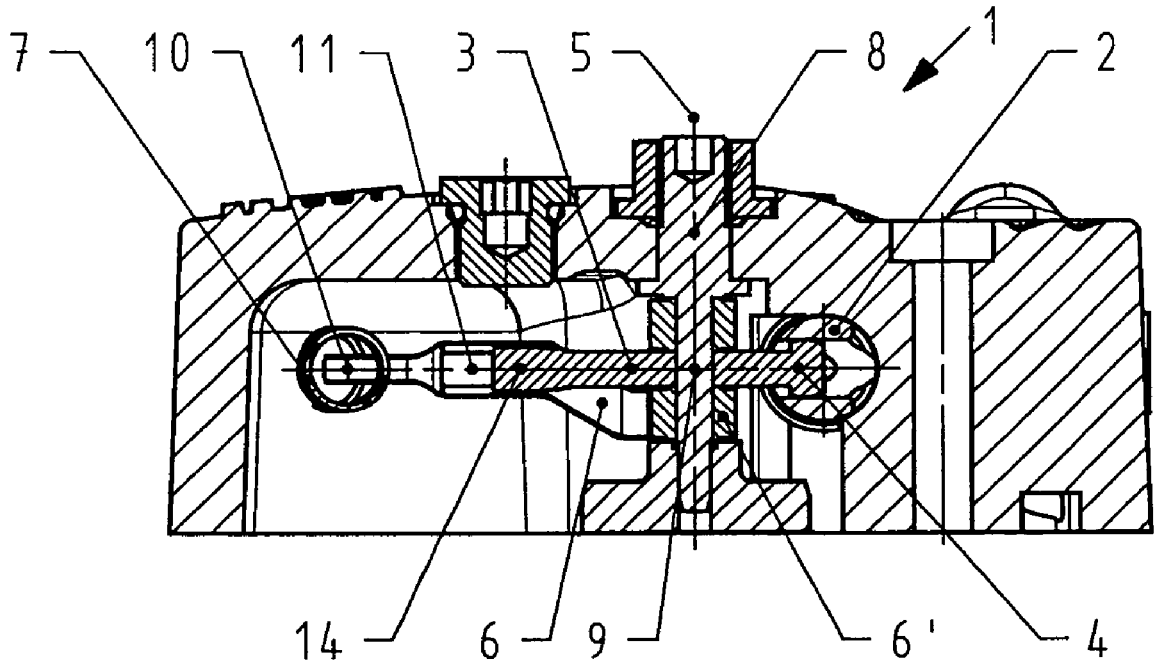
FIG. 1 shows the adjustment device of the axial piston machine in cross section.

FIG. 1 shows a cross section through the adjustment device 1. A control piston 2 is adjusted along a movement axis perpendicularly to the cross section shown by means of proportional magnets, with the result that an oil pressure which acts on the servopistons (not shown here) is made available. A pointer 3 which is embodied as a two-armed lever engages in the control piston 2, which, with its movement, rotates the pointer 3 about the pivot axis 5. The pointer 3 is guided here in a bore of the control piston 2 outside its movement axis and centre line, by means of a ball guide 4.

On each side of the pointer 3, a spring lever 6, 6' is also mounted on the pivot axis 5, this bearing being embodied in such a way that tilting moments are avoided as far as possible. Such tilting moments can be produced by the forces which are exerted on the spring levers 6, 6' by the control piston 2 and by the traction spring 7 which stresses the spring levers one against the other. It is possible, for example, to use roller bearings to mount the spring levers 6, 6' and the pointer 3.

The pivot axis 5 is formed by a pin-shaped, cylindrical axial bolt 8 which is mounted on each side in the housing and has an eccentric section 9 in its central part on which the spring levers 6, 6' and the pointer 3 are mounted. The eccentricity is dimensioned here such that, by rotating the axial bolt 8, the pivot axis 5 can be displaced sufficiently to be able to set the zero position. Owing to the small degree of offset, no particular distinction is made between the pivot axis 5 and the axis of rotation of the axial bolt 8 in the drawing.

The traction spring 7 is clamped into the fork-like ends 10—facing away from the pivot axis 5—of the spring levers 6, 6'. On the one hand, the pointer head 14 rests on the bearing faces 11, 11' of the spring levers 6, 6', and if the bearing faces 11, 11' protrude beyond said pointer head 14, a pin (not shown) which is connected to the swash plate and which transmits the angular position of the swash plate to the spring levers 6, 6' also bears on them. The pivoting movement of said swash plate is directed essentially perpendicularly to the plane of the drawing in FIG. 1 here.

The control piston 2 has a defined home position. It is brought about by the two spring levers 6, 6', the pointer 3 which is embodied as a two-armed lever, the traction spring 7, the pivot axis 5 and a connection to the swash plate, in the following way: the spring levers 6, 6' and the pointer 3 are mounted together on the pivot axis 5 in a rotatable fashion. The spring levers 6, 6' are connected at their ends to a traction spring 7 which pulls the spring levers 6, 6' one against the other in the manner of a closing clamp, the spring levers 6, 6' enclosing one end of the pointer 3 and at the same time the mechanical contact with the swash plate which is pressed into its home position by strong spring forces. When the clamp which closes the contact with the swash plate is closed, the pointer 3 is also clamped in by its end lying between them, by the spring levers 6, 6', in such a way that its play between them is virtually zero. At its other end, the pointer 3 engages in the control piston 2 and holds it in its home position. In this home position, the control piston 2 does not conduct any oil to the servopiston and the swash plate is held in the neutral position by strong springs.

So that no oil is actually made available to the servopistons in the neutral position of the control pistons 2, the position of the pointer 3, which, as a result of the spring levers 6, 6', is already aligned at one end in relation to the swash plate, has to be appropriately set. This is done by displacing the pivot axis 5.

If a sufficiently large electric current flows through one of the proportional magnets 12, 12', the control piston is pushed along its movement axis by the tappet of the proportional magnet. This forces the pointer 3 to rotate about the pivot axis 5, and to spread apart the clamp formed from the spring levers 6, 6' and the traction spring 7. In the process, the one spring lever 6 maintains mechanical contact with the swash plate, while the other spring lever 6' rotates in the same direction with the pointer 3 about the pivot axis 5, and thus moves out of mechanical contact with the swash plate.

As a result, owing to the movement of the control pistons, oil is fed to the servopistons of the axial piston machine and the swash plate is pivoted. The oilconducting connections are expediently embodied in such a way that the movement of the swash plate by means of the mechanical contact with respect to the spring lever 6, which is still in the resting position, causes the latter to rotate in the opposite direction to the other spring lever 6'. As a result, the stretched traction spring 7 pulls the spring lever 6'—previously deflected by the proportional magnet and the pointer 3—back into its home position, together with the pointer 3 and control piston 2. In the process, the spring force and the force of the proportional magnet are balanced and a specific position of the swash plate is assigned to each force level.

Figure 2:
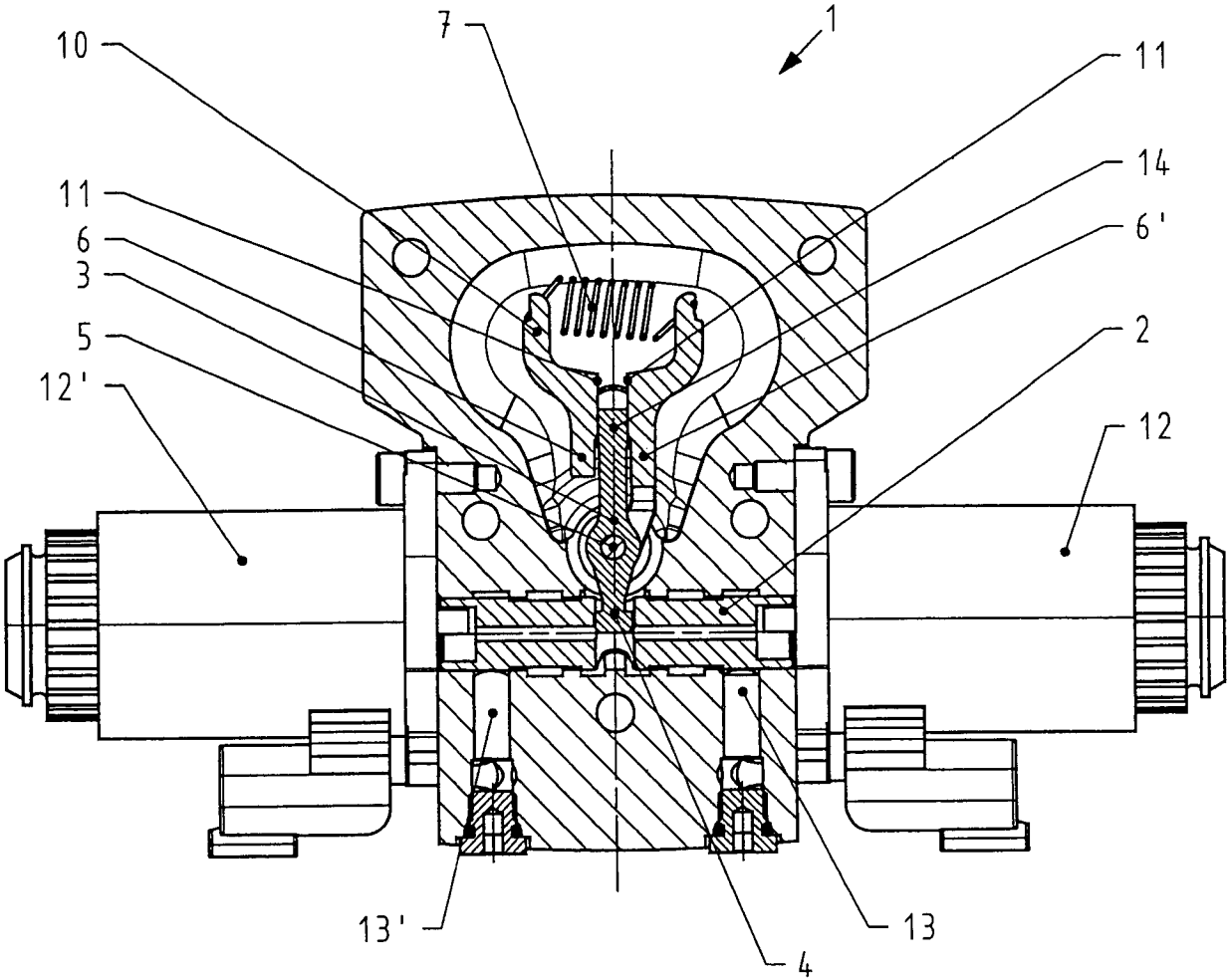
FIG. 2 shows the adjustment device of the axial piston machine in a section which is perpendicular to FIG. 1, FIGS. 3*a*, 3*b*, 3*c*, 3*d* show the bearing of the pointer and of the spring levers according to one embodiment of the invention.

FIG. 2 shows the adjustment device in a section which is perpendicular to FIG. 1. In what follows, the same reference symbols as in FIG. 1 are retained for identical components. In the adjustment device 1, the control piston 2 is moved by proportional magnets 12, 12', an oil flow which supplies the control piston being made available via the ducts 13, 13'. The pointer 3 engages in a bore in the control piston 2 on one side of its pivot axis 5, the point of engagement of its end 4, which is of conical construction, lying on the tappet axis of the magnets 12, 12' and being offset with respect to the centre line of the control piston, in order to avoid tilting moments and rotation of the piston. There is a continuous bore through the centre of the control piston 2 along its centre line in order to conduct away leakage oil.

The pointer 3 engages between the spring levers 6, 6', on the side of the pivot axis facing away from the control piston 2, and said pointer 3 lies with its head 14 on part of the bearing faces 11, 11', which parts are specially processed, in particular coated, in order to avoid abrasion. The same applies to the pointer head 14 which is circular-cylindrical in the example shown but may also be embodied with a rectangular cross section or in the shape of a sphere. A pin (not illustrated) which is connected to the swash plate and transmits its angular position rests on the part of the bearing faces 11, 11' which projects beyond the pointer head. When the control piston 2 moves, the pointer head 14 presses the spring levers 6, 6' apart from one another, counter to the resistance of the pin which is connected to the swash plate.

FIGS. 3*a* to 3*d* show different views of a preferred embodiment of the adjustment device 1 according to the invention. The pointer 3 engages, on one side of its pivot axis 5, in the control piston 2, and on the other side with the cylindrical pointer head 14, between the spring levers 6, 6' and rests there on the coated bearing faces 11, 11'. The spring levers 6, 6' and pointer 3 are each mounted directly on the eccentric part 9 of the axial bolt 8. The spring levers 6, 6' are bent, each engage on the opposite side of the pointer 3 before the pivot axis 5 and each form a bearing shell 15, each of which is composed in turn of two separate component shells between which the pointer 3 is held. The bearing shells 15 each enclose, with the exception of an angular region which is necessary for sufficient spreading of the spring levers, a half-space about the pivot axis 5. This results in a very symmetric arrangement in which the spring levers 6, 6' can hardly tilt at all because they are each supported on the pivot axis at two locations by means of the divided bearing shells 15.

Figure 3:
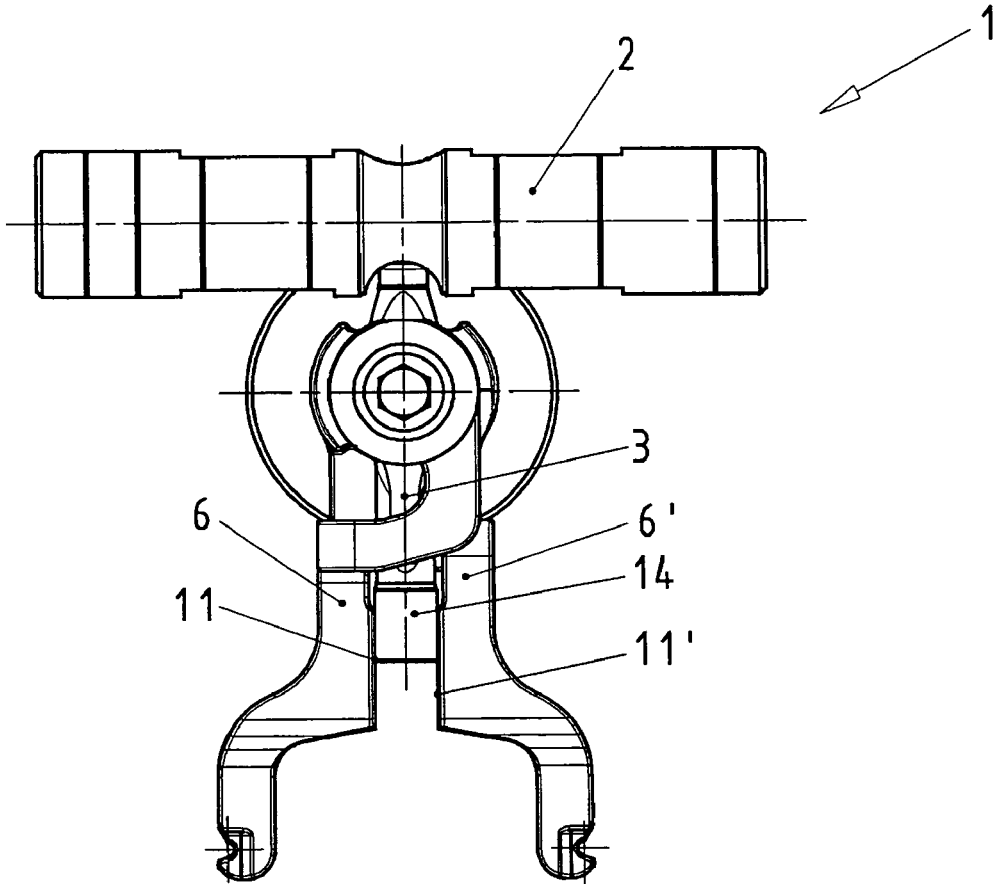
Figure 3:
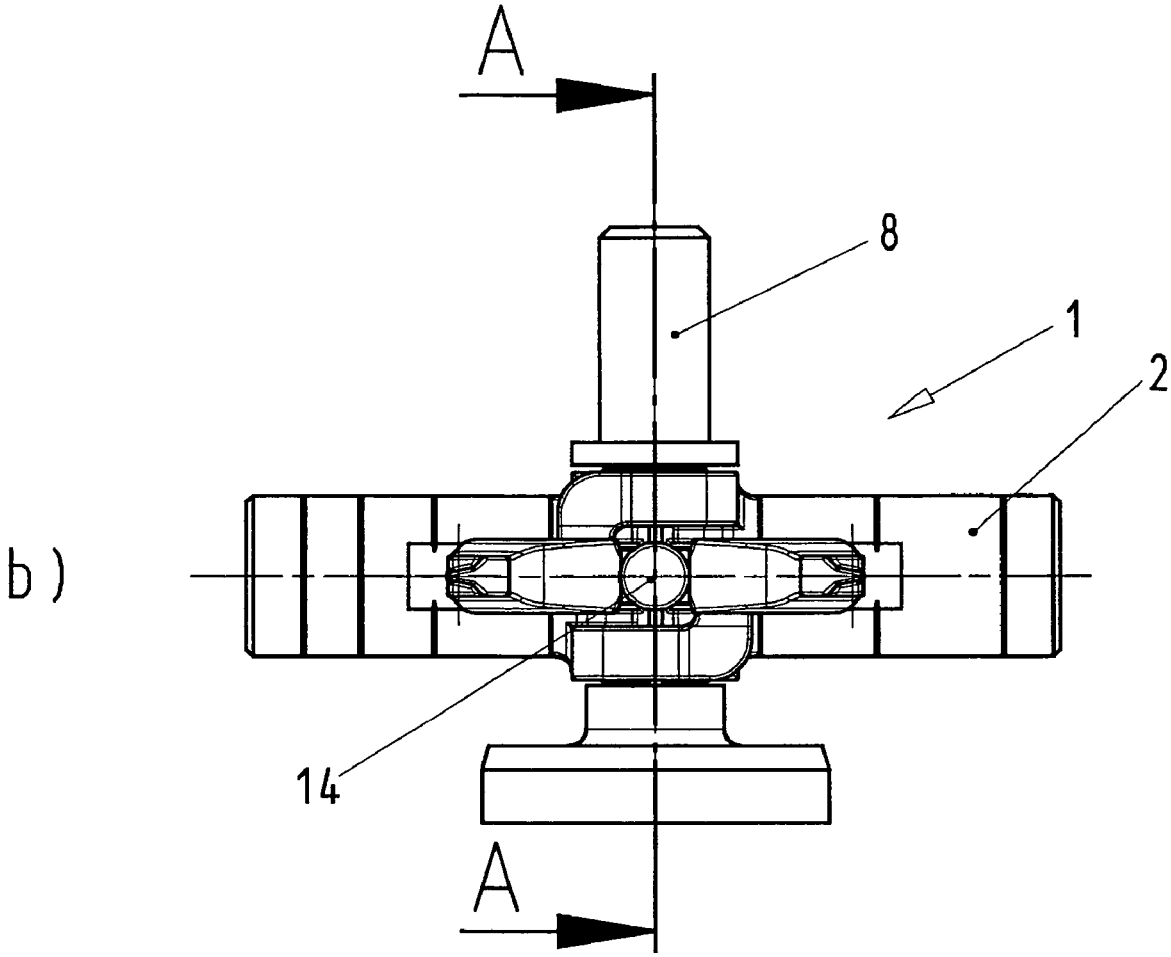
Figure 3:
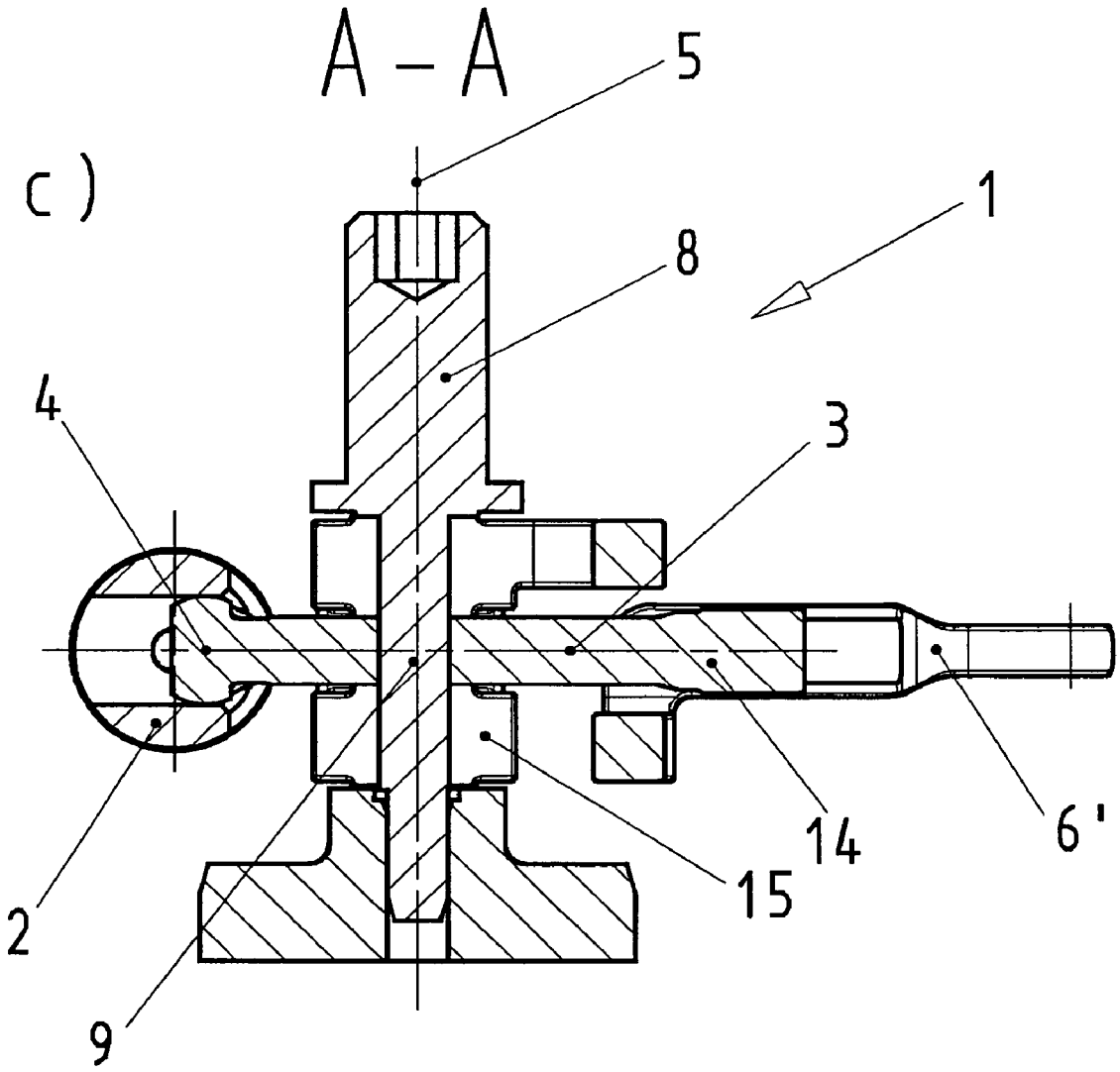
Figure 3:
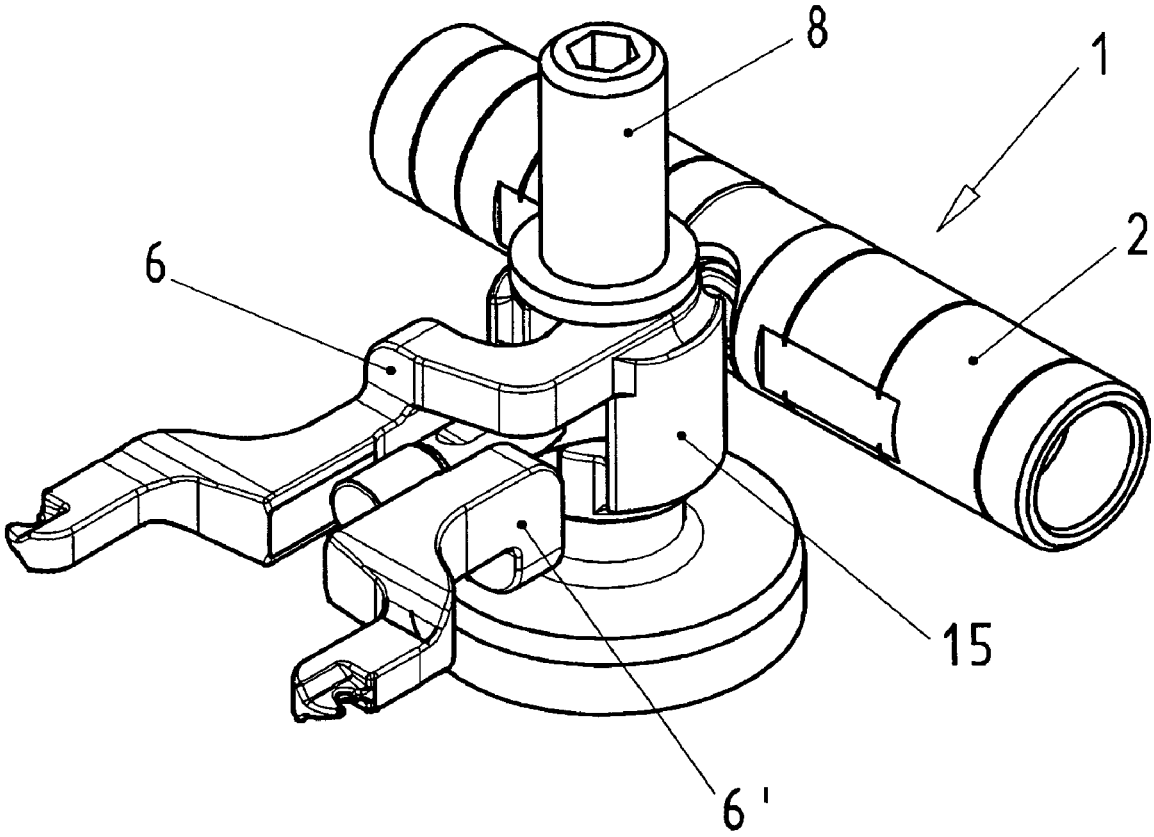
Figure 4:
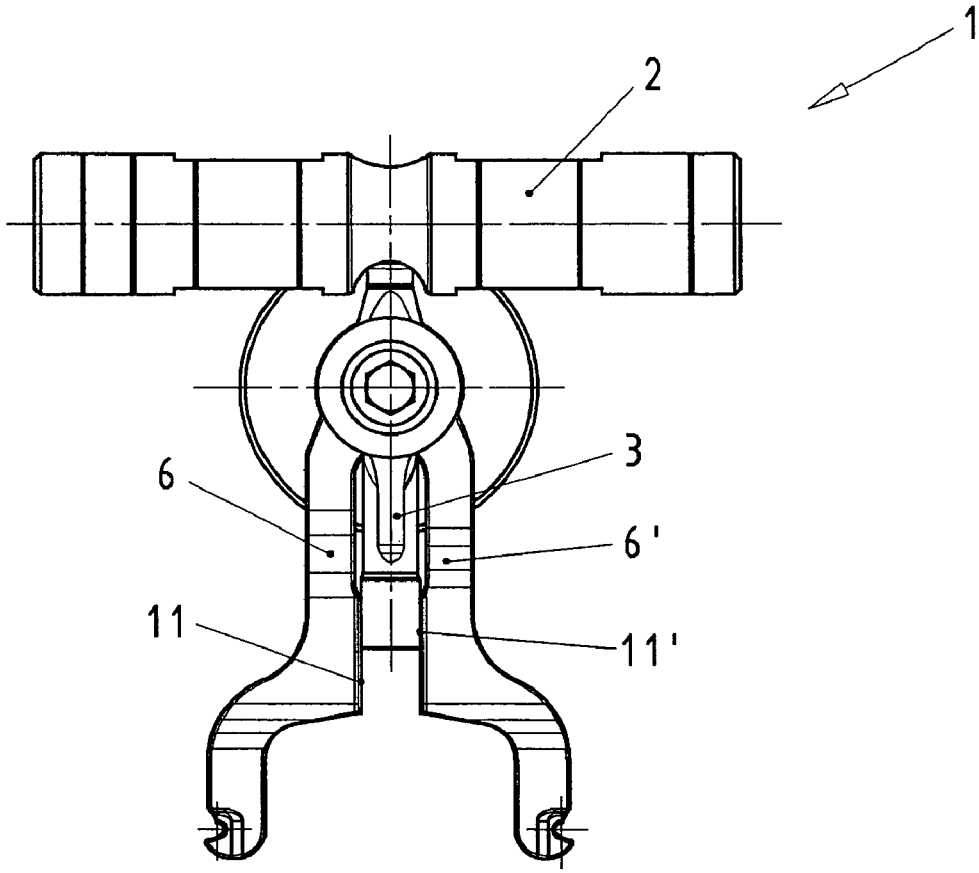
FIGS. 4*a*, 4*b*, 4*c*, 4*d* show the bearing of the pointer and of the spring levers according to a third embodiment.
Figure 4:
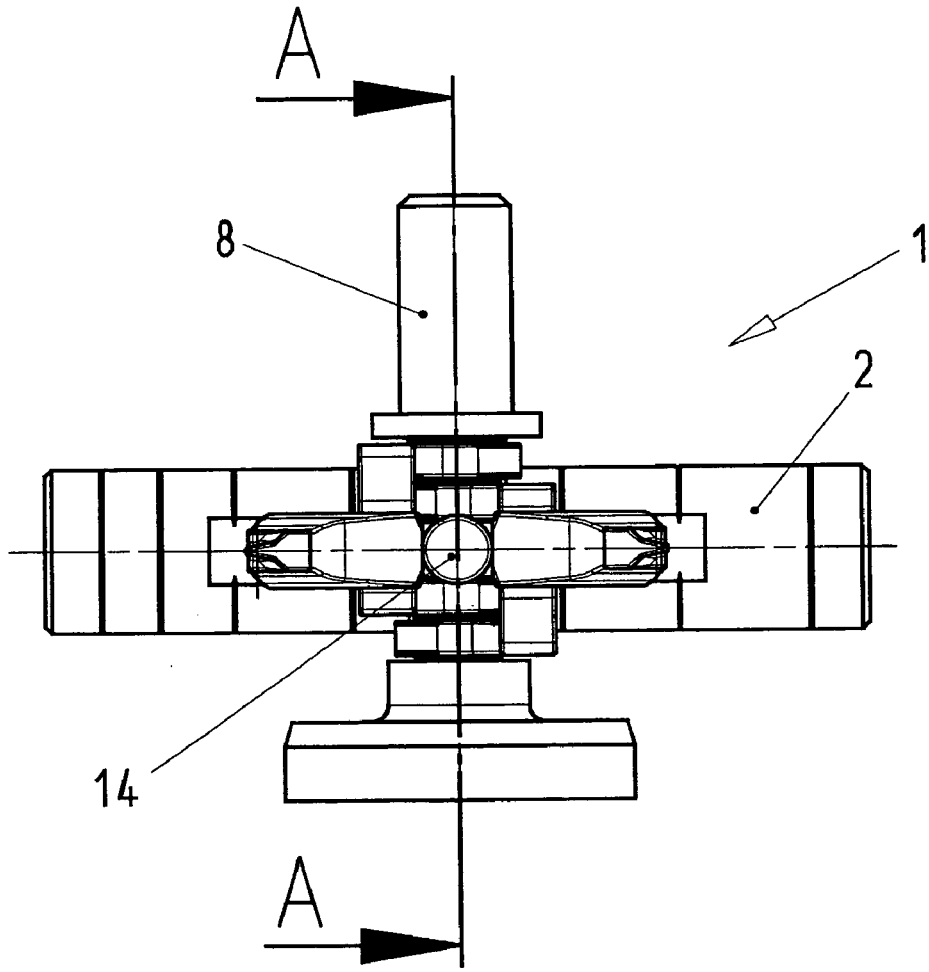
Figure 4:
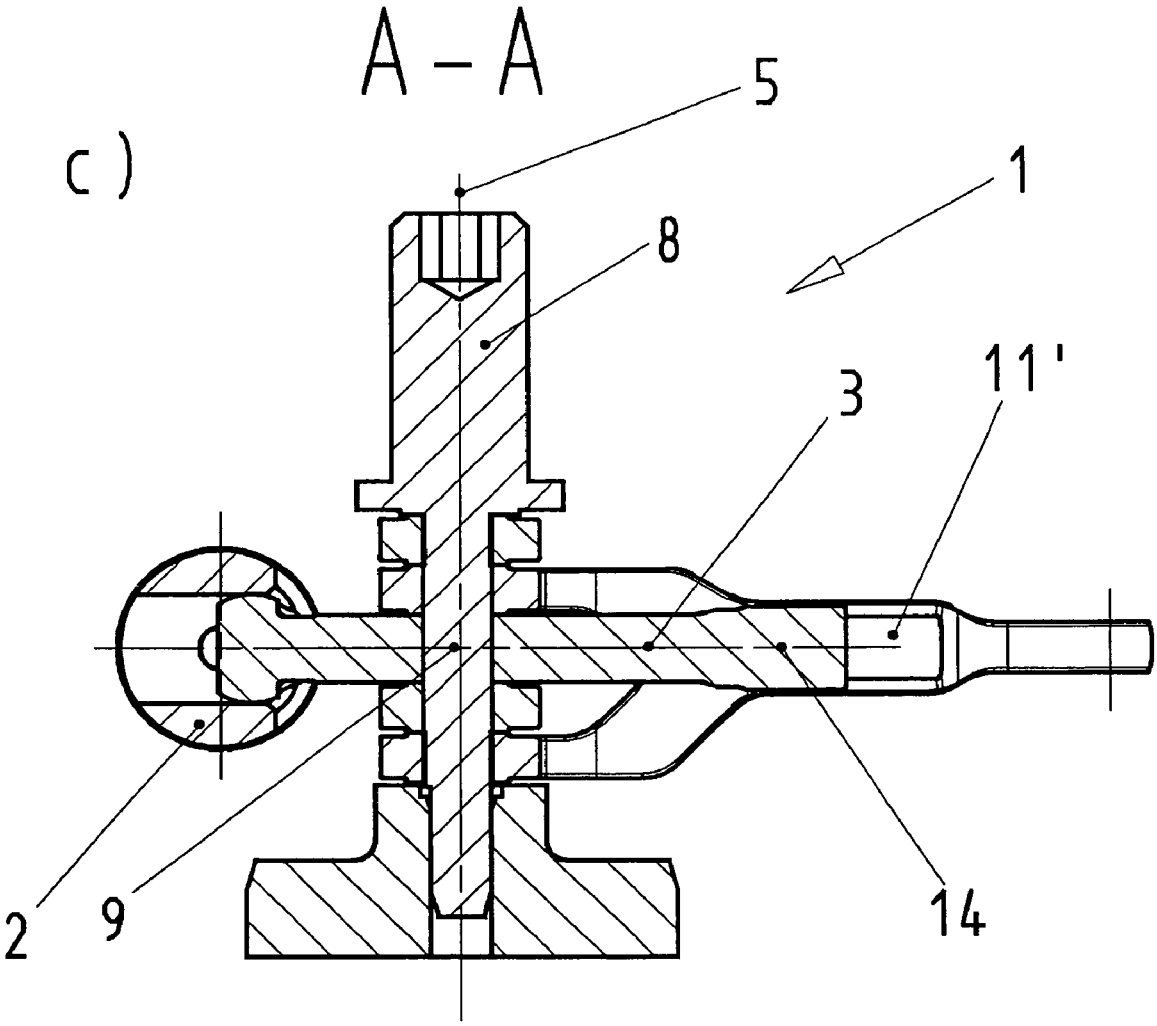
Figure 4:
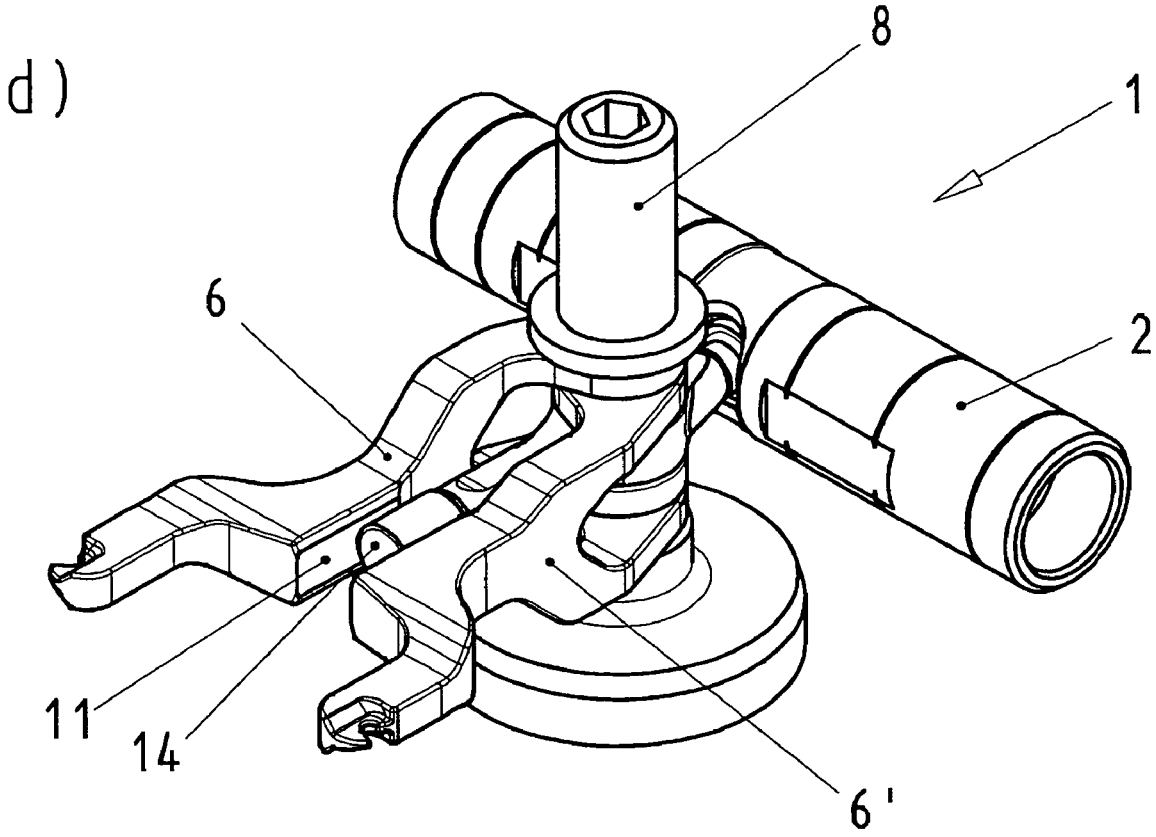
Figure 5:
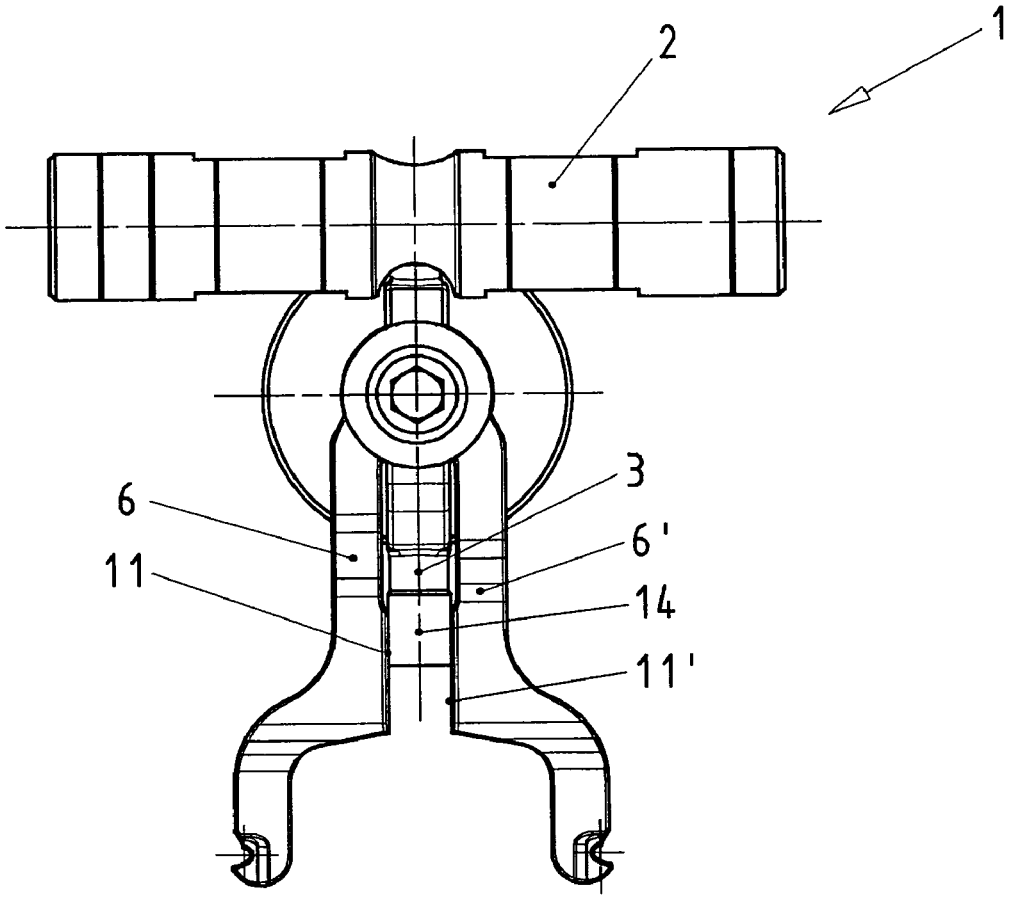
FIGS. 5*a*, 5*b*, 5*c*, 5*d* show the bearing of the pointer and of the spring levers on the pivot axis according to a fourth embodiment.
Figure 5:
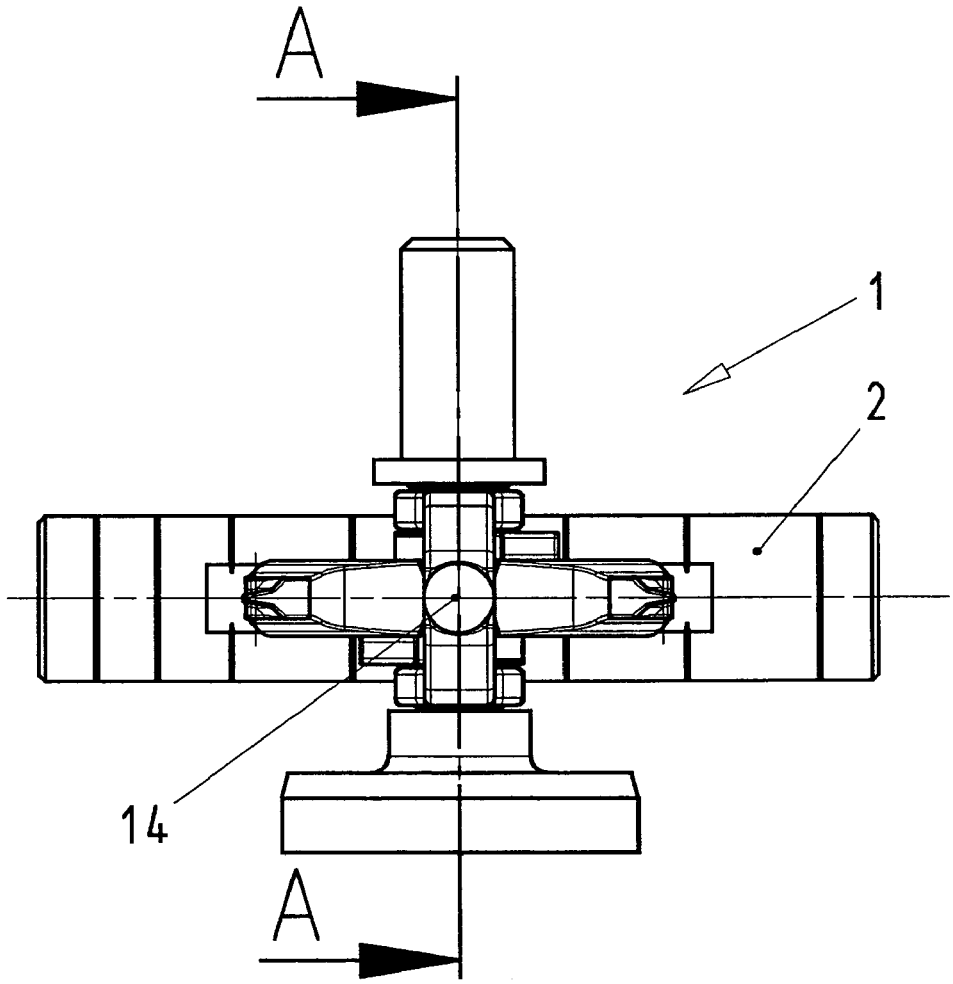
Figure 5:
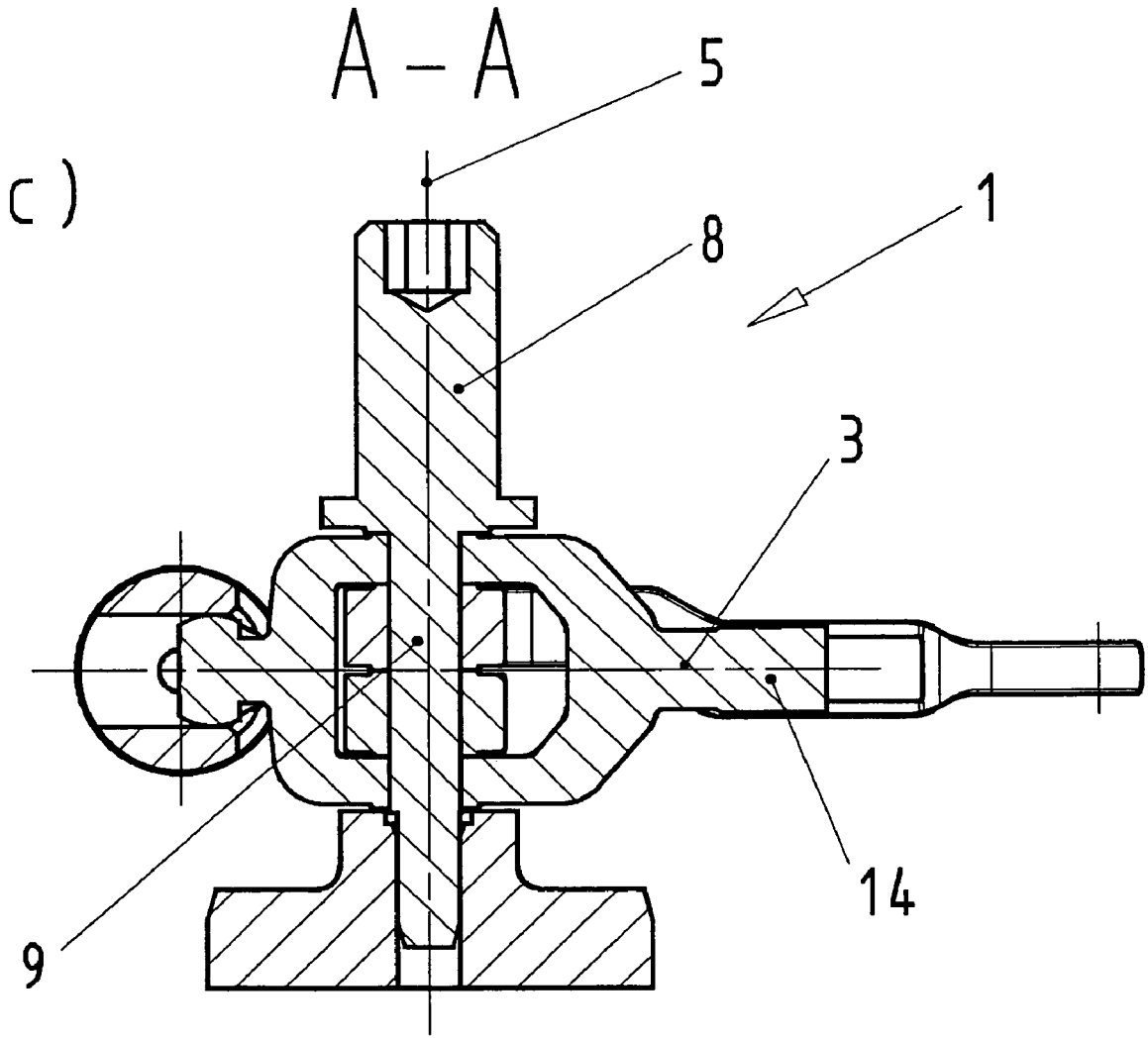
Figure 5:
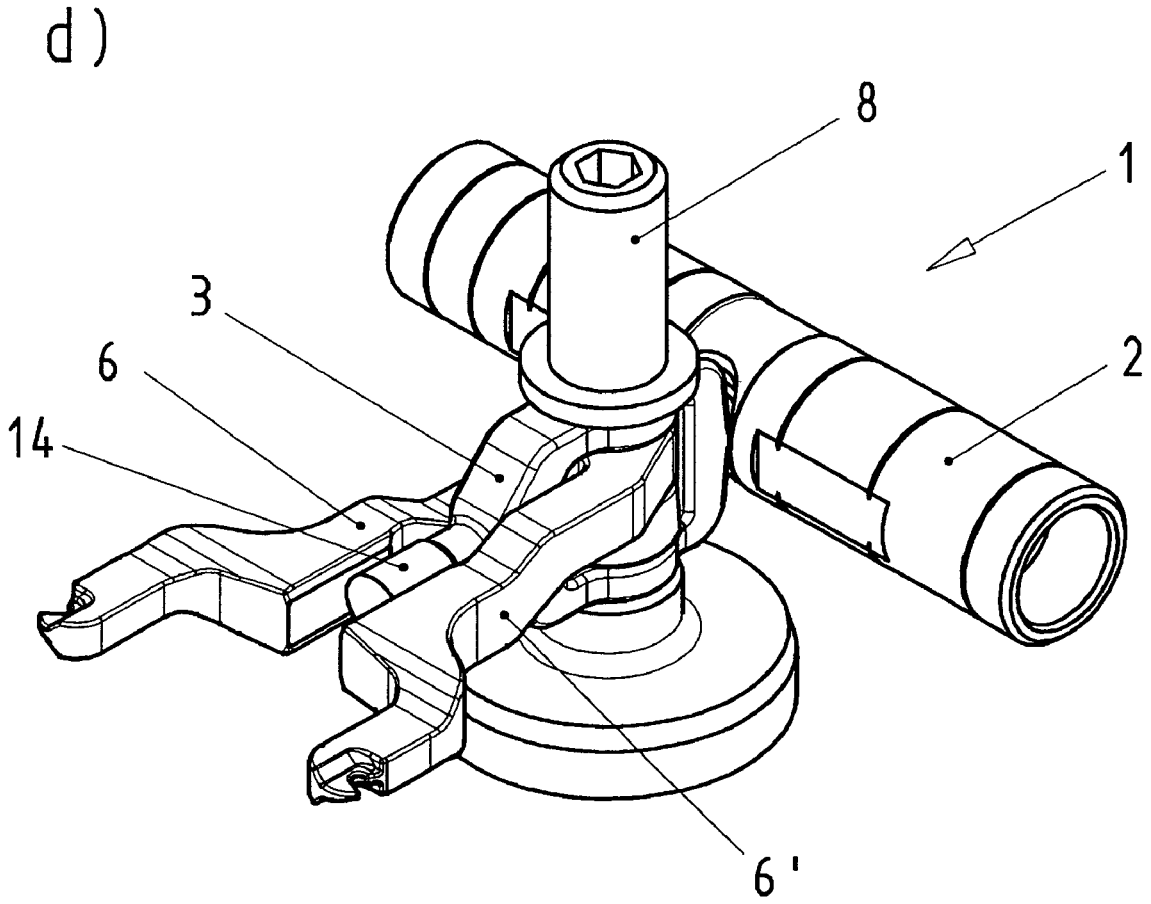

Further embodiments of a largely tilt-free means of bearing the spring levers 6, 6' and pointer 3 are shown in FIGS. 4 and 5 in a similar representation to that in FIG. 3 and with the same reference symbols.

In the embodiment according to FIG. 4, the spring levers 6, 6' each engage around both sides of the pointer 3 in a symmetrical arrangement in the region of the pivot axis 5, the bearing of each spring lever 6, 6' being supported at two locations on the eccentric part 9 of the axial bolt 8, in the manner of a fork, on both sides of the pointer 3. In the embodiment according to FIG. 5, the pointer 3 is embodied in the region of the pivot axis 5 as a fork so that it is mounted on the eccentric section 9 of the axial bolt 8 at two locations. The bearing shells of the spring levers 6, 6' are arranged between the two bearings of the pointer 3. In the cases shown in FIGS. 3 to 5, in each case a symmetrical arrangement which is very resistant to tilting is obtained, the pointer engaging in each case centrally between the spring levers.

Figure 6:
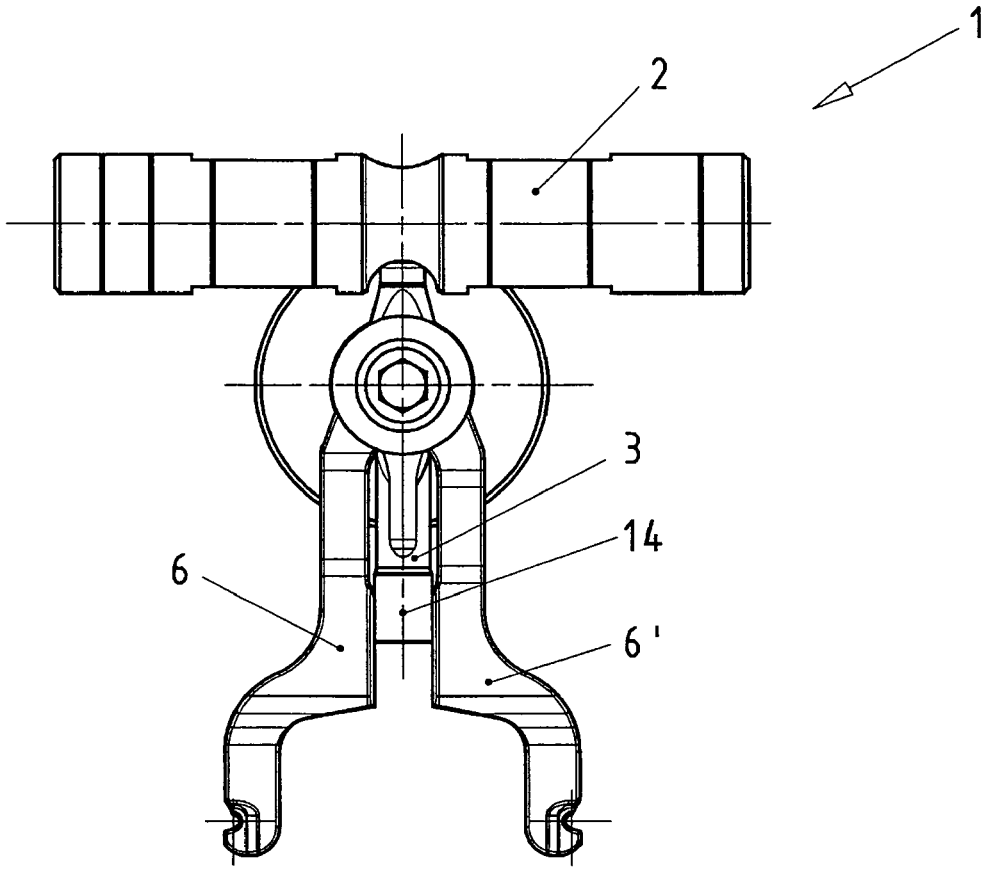
FIGS. 6*a*, 6*b*, 6*c*, 6*d* show the bearing of the pointer and of the spring levers on the pivot axis according to a fifth embodiment.
Figure 6:
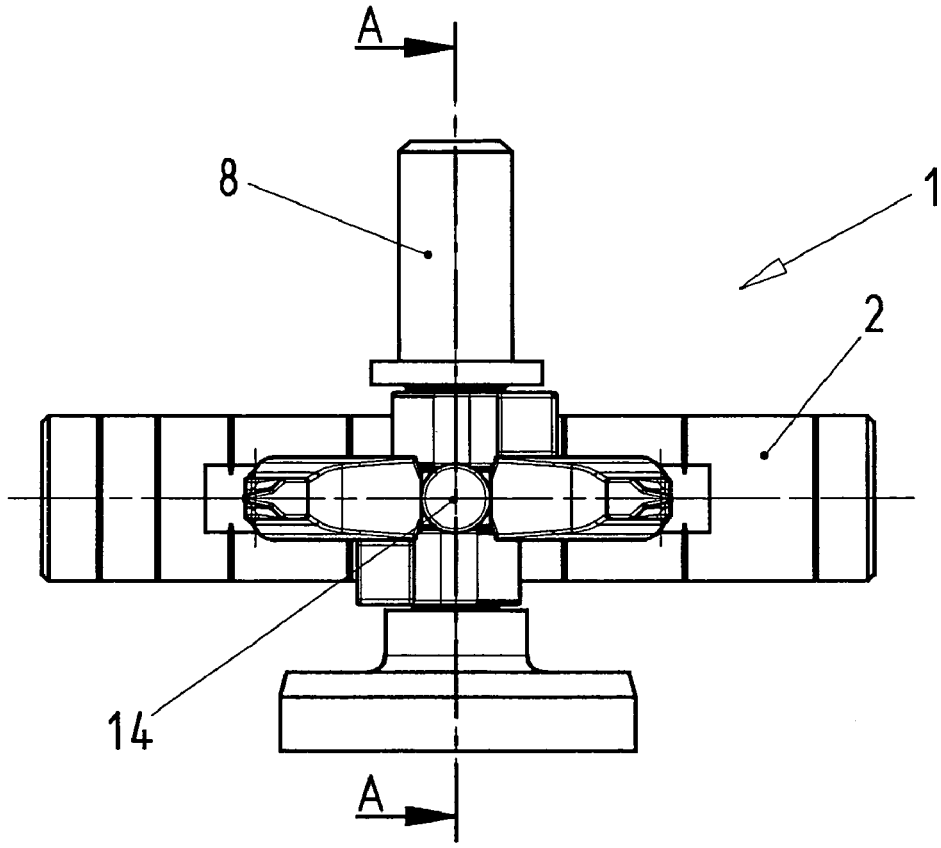
Figure 6:
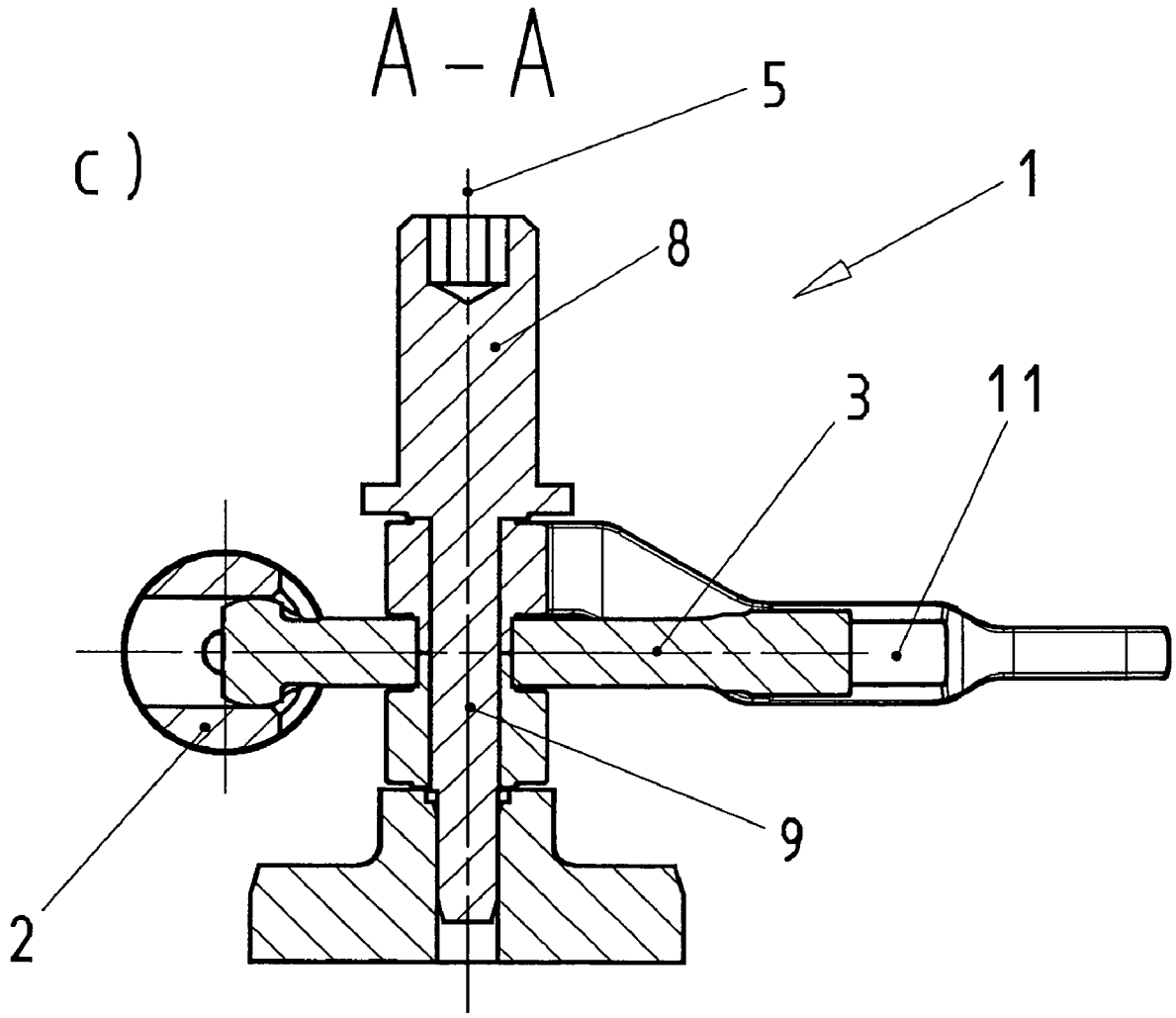
Figure 6:
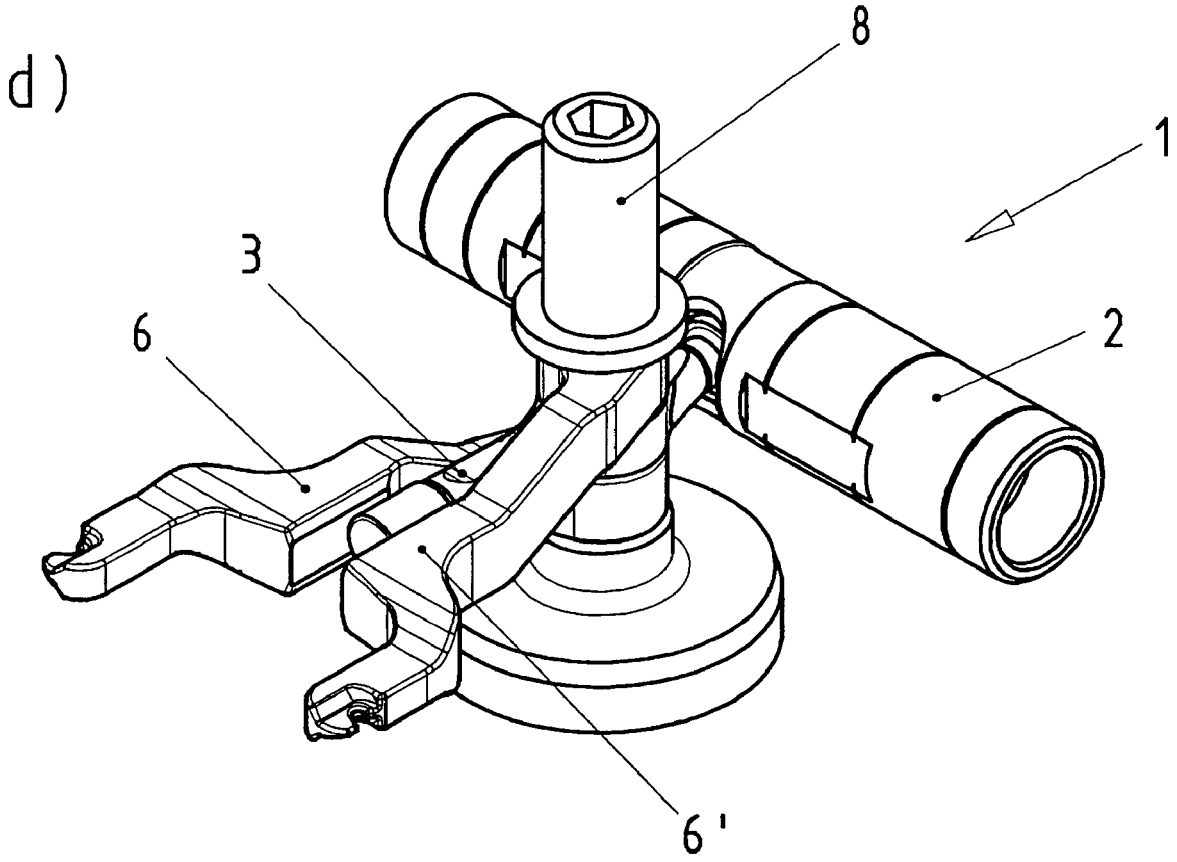

One particularly advantageous refinement of the adjustment device is shown by FIG. 6. The pointer 3 is not mounted directly on the eccentric section 9 of the axial bolt 8 here but rather on the spring levers 6, 6'. This reduces the frictional forces because the pointer 3 inevitably always follows the movement of one of the spring levers.

The invention results in an adjustment device which is a very compact construction, can be adjusted precisely and is resistant to tilting, it being possible to cover an entire series of axial piston machines with different volumetric displacements using one and the same adjustment device.

What is claimed is:

1. Axial piston machine having a swash plate or oblique axis which can be adjusted by means of servopistons and has a valve segment and an adjustment unit for the electrically proportional adjustment of the volumetric displacement, the adjustment unit comprising proportional magnets 12, 12' which can be activated electrically, and a control piston 2 for controlling the oil pressure which moves the servopistons, the proportional magnets 12, 12' acting on the control piston 2 along a common tappet axis, and a feedback device for feeding back the current swash plate or oblique axis valve segment position to the control piston 2 being provided, and the feedback device comprising spring levers 6, 6' and a pointer 3 which can be pivoted about an axis 5, the pointer 3 which is embodied as a two-armed lever engaging in the control piston 2 on one side of the pivot axis 5, and between the spring levers 6, 6' on the other side.

2. Axial piston machine according to claim 1, the spring levers 6, 6' being mounted on the pivot axis 5, each with a bearing shell 15, each of which is composed of two component shells which support the spring lever 6, 6' on the pivot axis at separate locations and each of which essentially encloses a half-space about the pivot axis 5.

3. Axial piston machine according to claim 1, the pointer 3 being mounted on the spring levers 6, 6'

4. Axial piston machine according to claim 1, the spring levers 6, 6' each being mounted in a fork-like fashion on the pivot axis 5, said levers being supported at two locations on the axis and enclosing the bearing of the pointer 3 between them.

5. Axial piston machine according to claim 1, the pointer 3 being mounted with a fork on the pivot axis 5 so that the pointer is supported at two locations on the axis and the fork of the pointer 3 encloses the bearings of the spring levers 6, 6'.

6. Axial piston machine according to one of claim 1, the pointer head 14 and the faces 11, 11' of the spring levers on which the pointer head bears being processed separately, specifically the processing including coating, in order to reduce friction.

7. Axial piston machine according to one of claim 1, the pointer header 14 being of cylindrical construction.

8. Axial piston machine according to one of claim 1, the pointer head 14 being of spherical construction.

9. Axial piston machine according to one of claim 1, the pointer head 14 having a rectangular cross section.

10. Axial piston machine according to one of claim 1, the end of the pointer 3 which engages in the control piston 2 being of spherical construction.

11. Axial piston machine according to one of claim 1, the point where the pointer 3 engages in the control piston 2 lying outside the center line of the piston.

12. Axial piston machine according to one of claim 1, the point where the pointer 3 engages in the control piston 2 lying on the tappet axis of the magnets 12, 12'.

13. Axial piston machine according to one of claim 1, the control piston 2 having, in the longitudinal direction, a bore through which leakage oil can be conducted away.

14. Axial piston machine of claim 1 having a series of machines with different volumetric displacements and the same adjustment device being provided for all the models in the series.

* * * * *